US012759669B2

(12) United States Patent
Jaworski et al.

(10) Patent No.: US 12,759,669 B2
(45) Date of Patent: Oct. 13, 2026

(54) WATERCRAFT WITH FUEL RESERVOIR

(71) Applicant: Alumacraft Boats Inc., St. Peter, MN (US)

(72) Inventors: Cody Robert Jaworski, Madison, WI (US); Luke Meyer, Allenton, MI (US)

(73) Assignee: AlumaCraft Boats Inc., St. Peter, MN (US)

( * ) Notice: Subject to any disclaimer, the term of this patent is extended or adjusted under 35 U.S.C. 154(b) by 501 days.

(21) Appl. No.: 18/363,267

(22) Filed: Aug. 1, 2023

(65) Prior Publication Data

US 2025/0019041 A1 Jan. 16, 2025

Related U.S. Application Data

(60) Provisional application No. 63/513,697, filed on Jul. 14, 2023.

(51) Int. Cl.

| | |
|---|---|
| ***B63B 11/04*** | (2006.01) |
| ***B63B 1/12*** | (2006.01) |
| ***B63B 17/00*** | (2006.01) |
| ***B63B 19/19*** | (2006.01) |
| ***B63B 35/38*** | (2006.01) |

(52) U.S. Cl.

CPC ..... *B63B 11/04* (2013.01); *B63B 1/121* (2013.01); *B63B 17/0027* (2013.01); *B63B 19/19* (2013.01); *B63B 35/38* (2013.01)

(58) Field of Classification Search

CPC ..... B63B 17/0027

See application file for complete search history.

(56) References Cited

U.S. PATENT DOCUMENTS

| | | | | |
|---|---|---|---|---|
| 2,980,049 | A * | 4/1961 | Ward | B63B 3/38 114/140 |
| 4,406,630 | A * | 9/1983 | Wood, Jr. | B63H 5/125 114/57 |
| 2002/0038624 | A1* | 4/2002 | Nagata | B63B 25/08 114/343 |
| 2007/0125235 | A1* | 6/2007 | Begley | B63J 2/02 96/147 |
| 2016/0024736 | A1* | 1/2016 | Jauncey | E02B 15/048 210/747.6 |

FOREIGN PATENT DOCUMENTS

| | | | | |
|---|---|---|---|---|
| JP | H0745972 B2 * | 5/1995 | ..... | A45D 20/06 |

OTHER PUBLICATIONS

Machine translation of JP H0745972 (Year: 1995).*

* cited by examiner

*Primary Examiner* — Brian O Peters

(74) *Attorney, Agent, or Firm* — North Mullin & Kratz, PC LLO; Luke C. Holst

(57) ABSTRACT

A watercraft has a hull having a keel, a deck supported by the hull, and a compartment defined between the hull and the deck. A fuel reservoir is disposed in the compartment and extends longitudinally over the keel. The fuel reservoir has an external hollowed portion. At least one battery is at least partially disposed in the external hollowed portion.

18 Claims, 12 Drawing Sheets

WATERCRAFT WITH FUEL RESERVOIR

CROSS-REFERENCE

The present application claims priority to U.S. Provisional Patent Application No. 63/513,697, filed on Jul. 14, 2023 entitled "WATERCRAFT HAVING FUEL TANK WITH CUTOUT", the entirety of which is incorporated herein by reference.

FIELD OF TECHNOLOGY

The present technology relates to watercraft and to fuel reservoirs for watercraft.

BACKGROUND

Many watercraft are equipped with an internal combustion engine to power the propulsion system. One or more batteries are used for powering the starter motor and engine electronics, as well as other accessories such as trolling motors, fish finders, live wells, and sound systems. Typically, these batteries are stored in storage compartments above the deck. For instance, the batteries may be placed in the side or rear storage compartments of the watercraft, taking up valuable storage space above-deck which could be otherwise used to store other items that are more frequently accessed than the batteries, such as fishing rods, tackle boxes, and life jackets.

In view of the foregoing, there is a desire for an alternative for storing batteries on a watercraft.

SUMMARY

It is an object of the present technology to ameliorate at least some of the inconveniences present in the prior art.

According to one aspect of the present technology, there is provided a watercraft having a hull having a keel, a deck supported by the hull, and a compartment defined between the hull and the deck. The watercraft includes a fuel reservoir disposed in the compartment and extending longitudinally over the keel. The fuel reservoir includes an external hollowed portion. The watercraft further includes at least one battery at least partially disposed in the external hollowed portion.

In some embodiments, the external hollowed portion is a recess extending laterally inward from a lateral wall of the fuel reservoir.

In some embodiments, the recess is disposed longitudinally centrally along the lateral wall of the fuel reservoir.

In some embodiments, the at least one battery is disposed in the recess and laterally inwardly from the lateral wall.

In some embodiments, the watercraft further includes a support frame disposed in the external hollowed portion, wherein the at least one battery is connected to the support frame.

In some embodiments, the fuel reservoir is laterally centered about the keel.

In some embodiments, the fuel reservoir comprises a bottom left side surface and a bottom right side surface and the bottom left and right side surfaces define a generally V-shape.

In some embodiments, the hull is a V-shaped hull and the generally V-shape of the fuel reservoir is angled substantially similar to the V-shaped hull such that the fuel reservoir lays flat on the hull.

In some embodiments, the watercraft further includes a plurality of fasteners fastening the keel to a bottom surface of a hull body of the hull and a bottom surface of the fuel reservoir defines a longitudinally extending groove, the groove is sized for avoiding contact between the fasteners and the bottom surface of the fuel reservoir.

In some embodiments, the deck defines a hatch disposed above the at least one battery and the hatch door being configured to selectively close the hatch.

In some embodiments, a longitudinal distance between a rear face of the fuel reservoir and a rear end of the hull is less than a longitudinal distance between a front face of the fuel reservoir and a front end of the hull.

In some embodiments, the fuel reservoir is disposed laterally centrally in the hull In some embodiments, the at least one battery includes two batteries and the two batteries are disposed within the external hollowed portion of the fuel reservoir.

In some embodiments, one of the two batteries is disposed in front of another one of the two batteries.

In some embodiments, the watercraft further includes a power cable, the power cable connected to a terminal of the at least one battery and extending along a top of the fuel reservoir.

In some embodiments, the watercraft further includes at least one of an above-deck side compartment and an above-deck rear compartment.

In some embodiments, the hull has a first pontoon, a second pontoon, and a central portion disposed laterally between the first and second pontoons. The keel is a first keel of the first pontoon. The second pontoon has a second keel. The central portion has a third keel. The compartment is a first compartment defined between the first pontoon and the deck. The fuel reservoir is a first reservoir disposed in the first compartment and the at least one battery is at least one first battery disposed in the first compartment.

In some embodiments, a second compartment is defined between the second pontoon and the deck and the watercraft further includes: a second fuel reservoir disposed in the second compartment and extending longitudinally over the second keel, the second fuel reservoir comprising a second external hollowed portion and at least one second battery at least partially disposed in the second external hollowed portion.

In some embodiments, the at least one first battery comprises two first batteries and the at least one second battery comprises two second batteries.

In some embodiments, the watercraft further includes a first hatch door and a second hatch door. The deck defines a first hatch disposed above the two first batteries and a second hatch disposed above the two second batteries. The first hatch door being configured to selectively closes the first hatch and the second hatch door being configured to selectively closes the second hatch.

In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns.

It must be noted that, as used in this specification and the appended claims, the singular form "a", "an" and "the" include plural referents unless the context clearly dictates otherwise.

For purposes of this application, terms related to spatial orientation such as forward, rearward, upward, downward, left, and right, should be understood by a driver of a watercraft in which the watercraft is in a neutral trim position with the driver in an upright position.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

A watercraft 10 in accordance with an embodiment of the present technology is shown in FIGS. 1 to 4. The following description relates to one example of a watercraft 10, notably a fishing boat 10, as seen in FIGS. 1 to 4. Those of ordinary skill in the art will recognize that there are other known types of watercraft incorporating different designs and that the present technology would encompass these other watercraft.

Figure 1:
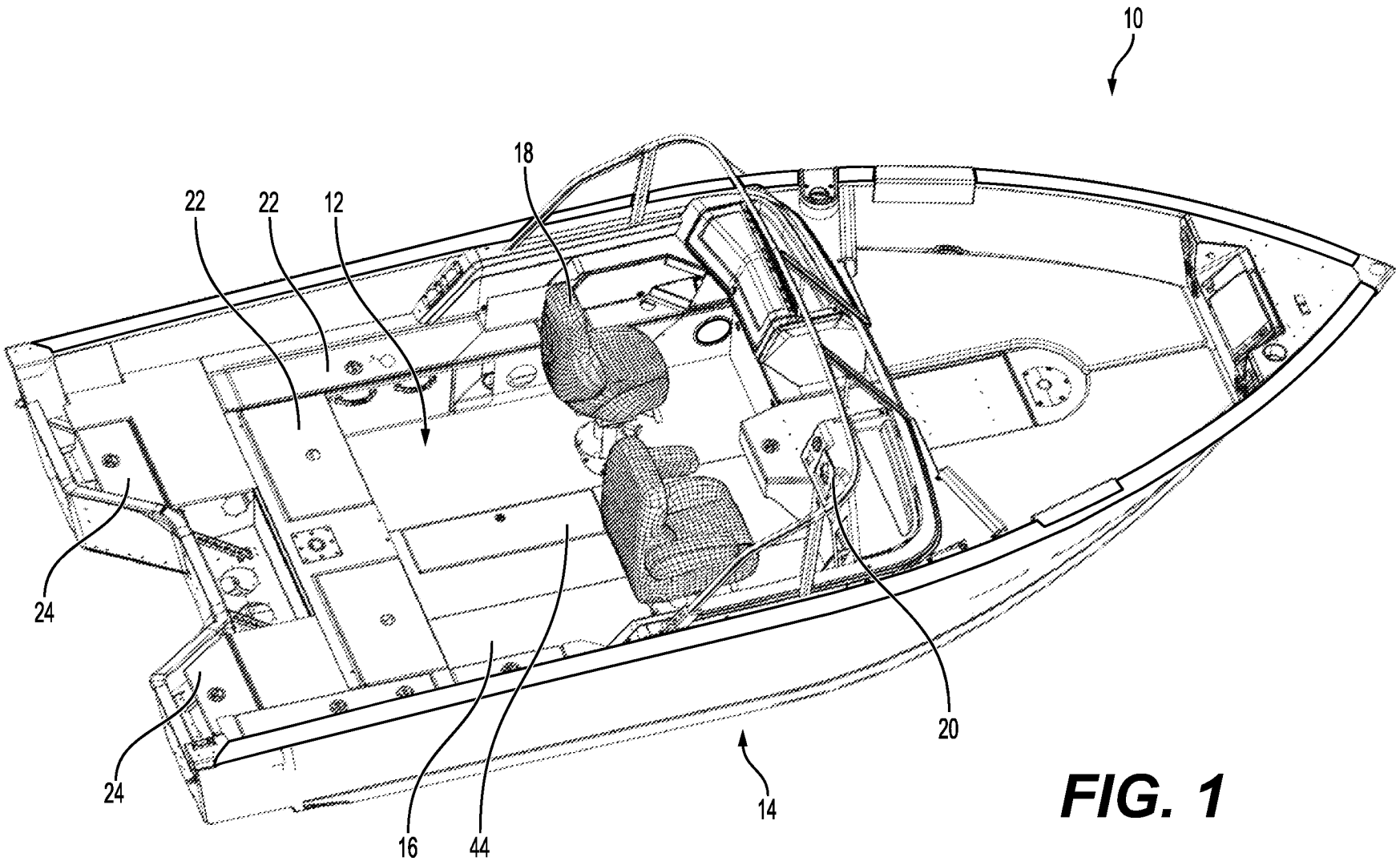
FIG. 1 is a perspective view of a watercraft taken from a top, rear, right side in accordance with an embodiment of the present technology.
Figure 2:
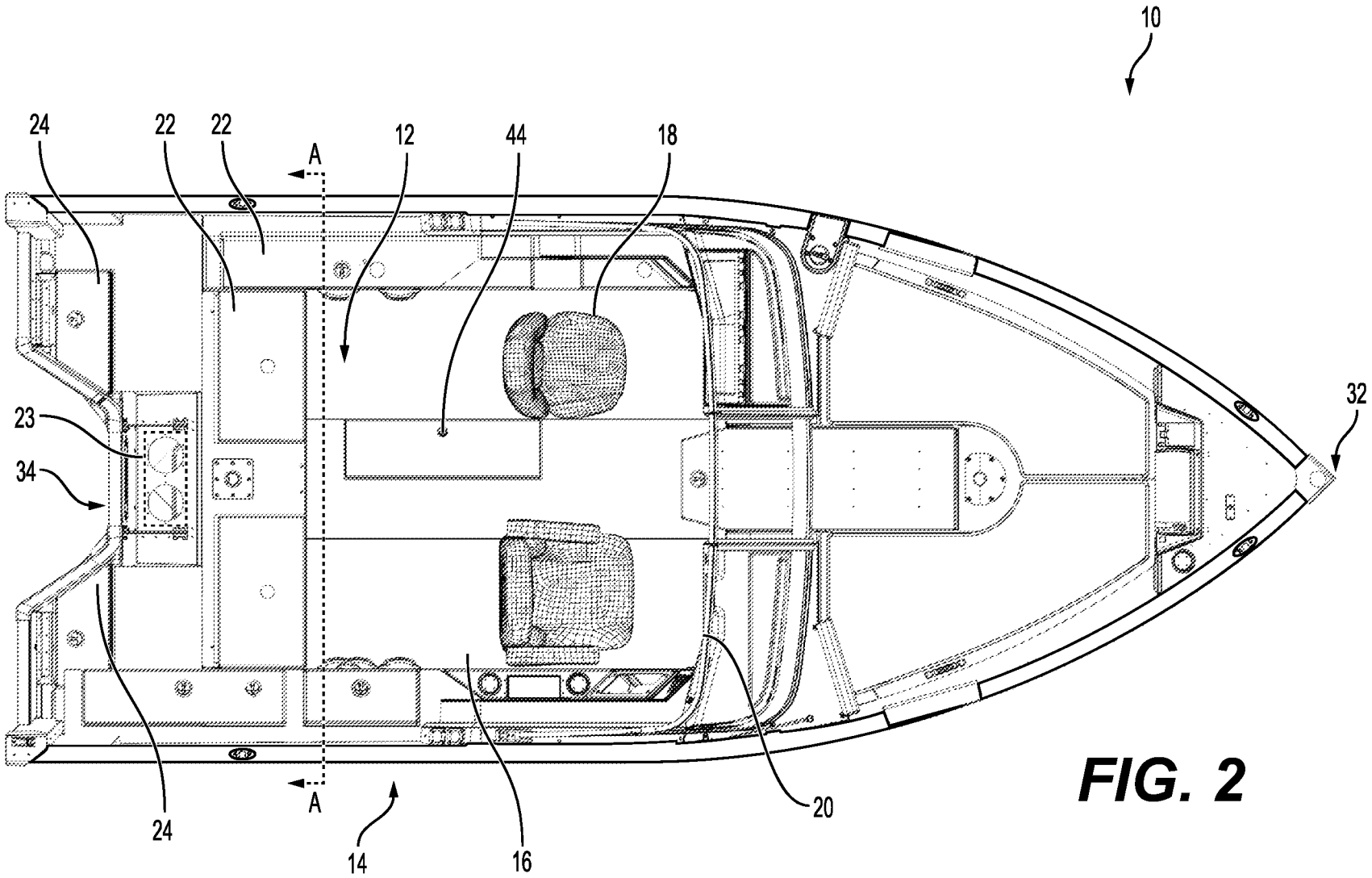
FIG. 2 is a top plan view of the watercraft of FIG. 1.

With reference to FIGS. 1 to 4, the boat 10 has a deck 12 and a hull 14 supporting the deck 12. The deck 12 extends above the hull 14 and has a generally flat upper surface 16. As seen in FIGS. 1 and 2, the upper surface 16 of the deck 12 is configured to support occupants, as well as accessories and accommodations of the boat 10, such as seating 18, a command console 20, as well as any number of above-deck storage compartments, including storage compartments 22 and rear storage compartments 24. The storage compartments 22, 24 are easily accessible to users for storing items which may be frequently accessed, for example fishing rods, tackle boxes, and life jackets. It is also contemplated that one or more of the storage compartments 22, 24 could define a live well. In some embodiments, each of the side and rear storage compartments 22, 24 include a door, hingedly connected to sidewalls of the respective storage compartment 22, 24 and a lock for selectively locking the door. It is contemplated, in other embodiments, that the storage compartments 22, 24 may be accessed by selectively removing a top panel of the storage compartments 22, 24. It is further contemplated, in other embodiments, that the storage compartments 22, 24 may remain open.

Figure 4:
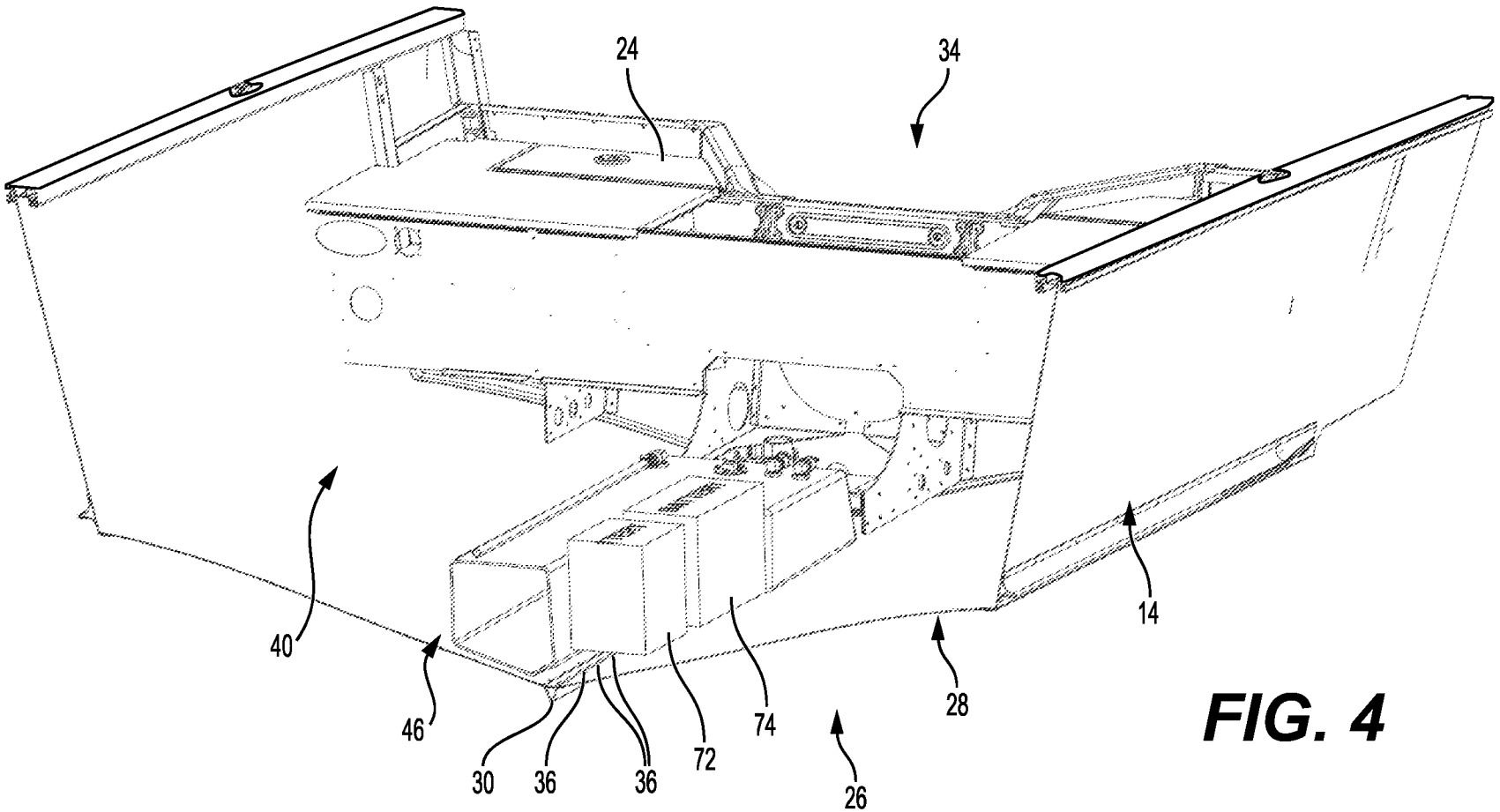
FIG. 4 is a cross-sectional view of the watercraft of FIG. 1 taken through line A-A of FIG. 2.

With reference to FIG. 4, in this embodiment, the hull 14 has a hull body 26 with the deck 12 extending across the hull 14. A bottom 28 of the hull 14 is angled, forming a V-shape and has a keel 30. The keel 30 extends longitudinally along a centerline of the hull 14 (e.g., at the vertex of the V-shaped hull 14) between a front end 32 and a back end 34 of the boat 10. The keel 30 is fastened to the bottom 28 of the hull 14 by a plurality of fasteners 36 such as bolts, screws, etc.

Figure 3:
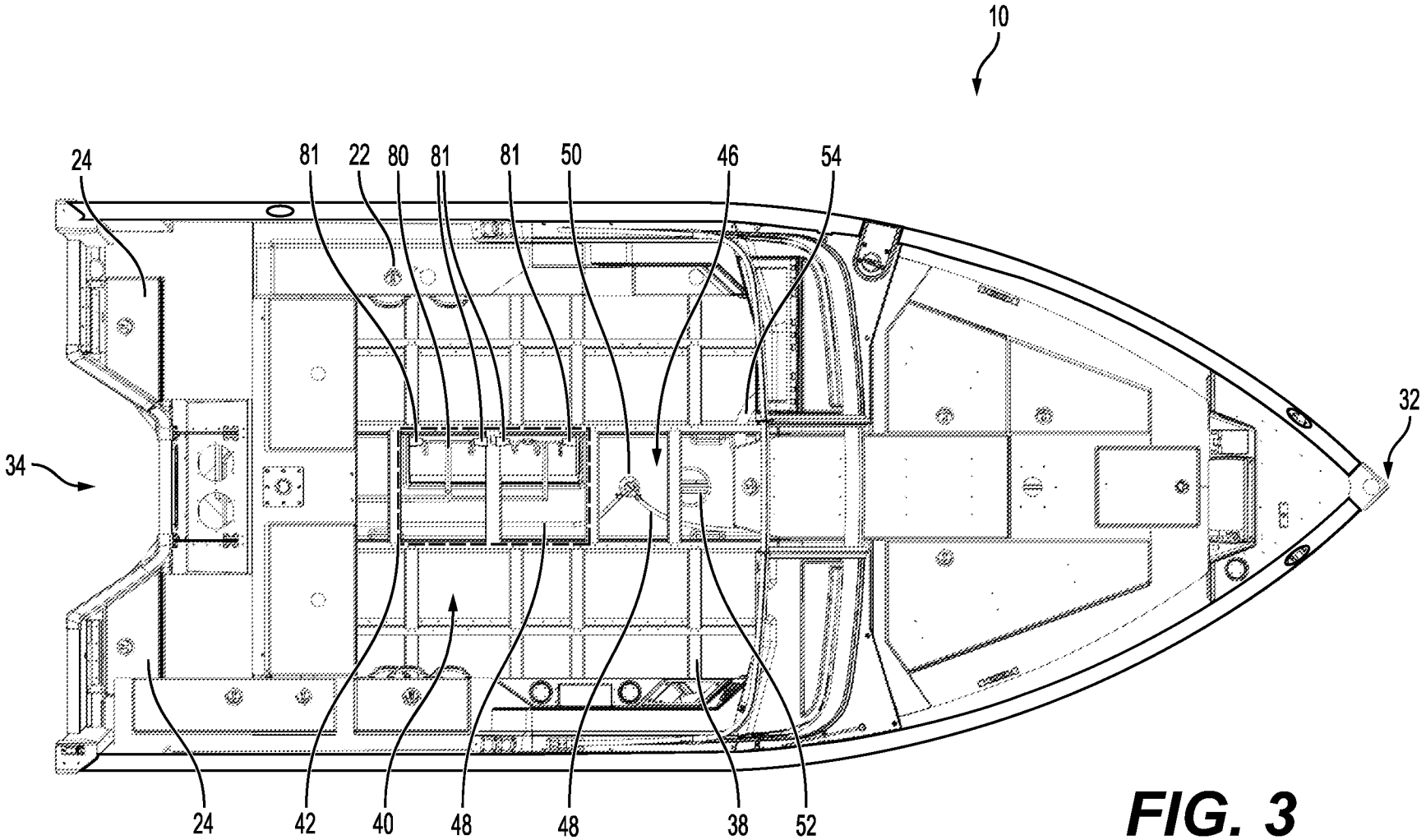
FIG. 3 is a top plan view of the watercraft of FIG. 1 with a portion of the deck removed.

In some embodiments, as seen in FIG. 3, the boat 10 has a frame 38 connected to the hull 14 for supporting the deck 12. The frame 38 supports an overlaying floor layer which forms a portion of the upper surface 16 of the deck 12. In some embodiments, the overlaying floor layer includes a plurality of tiles supported by the frame 38. In alternative embodiments, the overlaying floor layer may include wooden panels or plywood.

With continued reference to FIGS. 1 to 4, the boat 10 further includes a compartment 40 disposed below the deck 12, such that the compartment 40 is defined between the deck 12 and the hull 14. In the present embodiments, the compartment 40 is defined by a combination of the deck 12, the frame 38, and the hull 14. The deck 12 defines a hatch 42, granting access to the compartment 40. The hatch 42 is selectively closed via a hatch door 44. As seen in FIGS. 1 and 2, the hatch door 44 is configured to be flush with the upper surface 16 of the deck 12 and includes a latch or lock to secure the hatch door 44 in place when the compartment 40 is not being accessed. The hatch door 44 may be selectively removable from the hatch 42 and the deck 12. In alternative embodiments, the hatch door 44 may connected to the deck 12 via a hinge for example.

Figure 5:
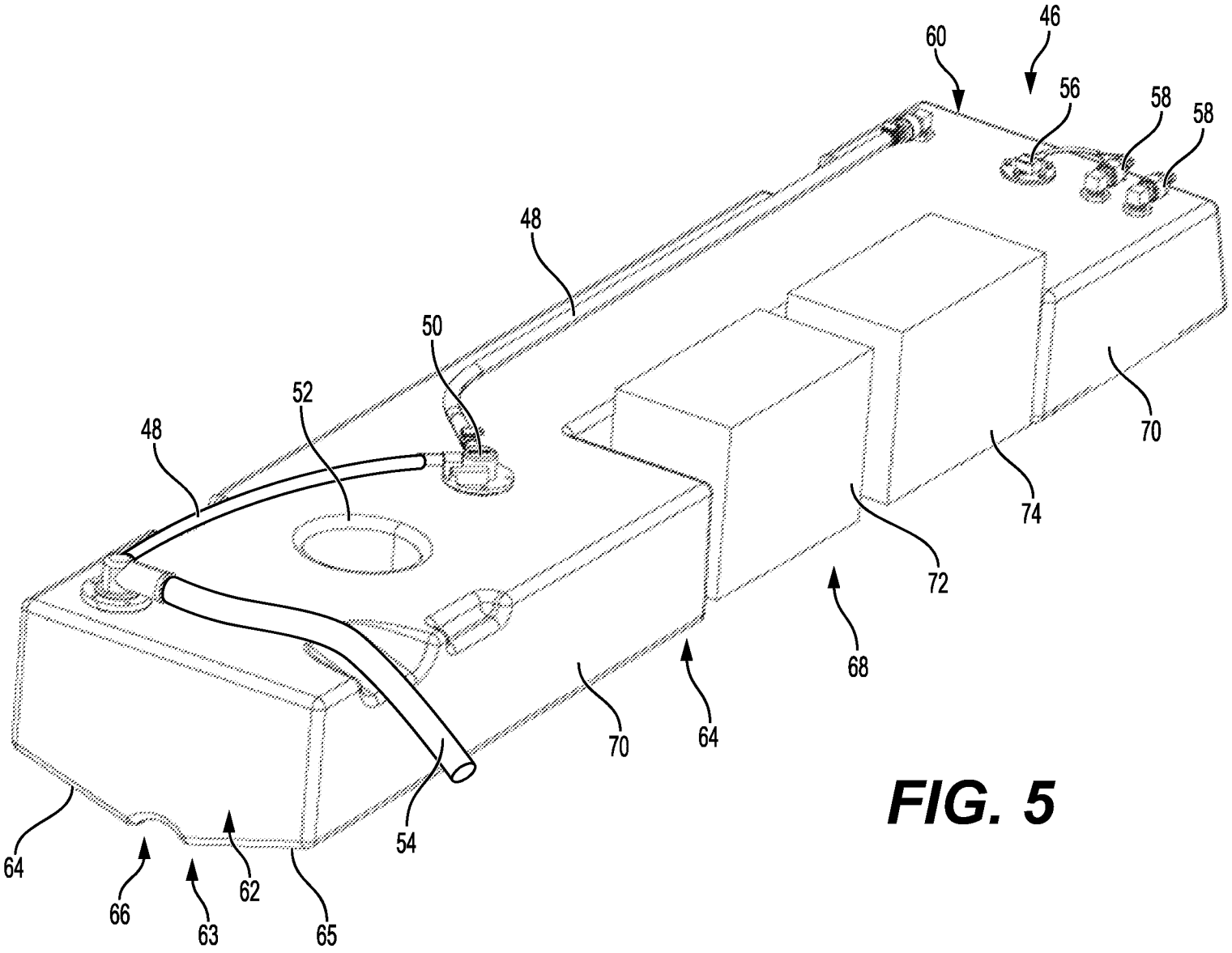
FIG. 5 is a perspective view of a fuel reservoir and a pair of batteries of the watercraft of FIG. 1 taken from a top, front, left side.
Figure 6:
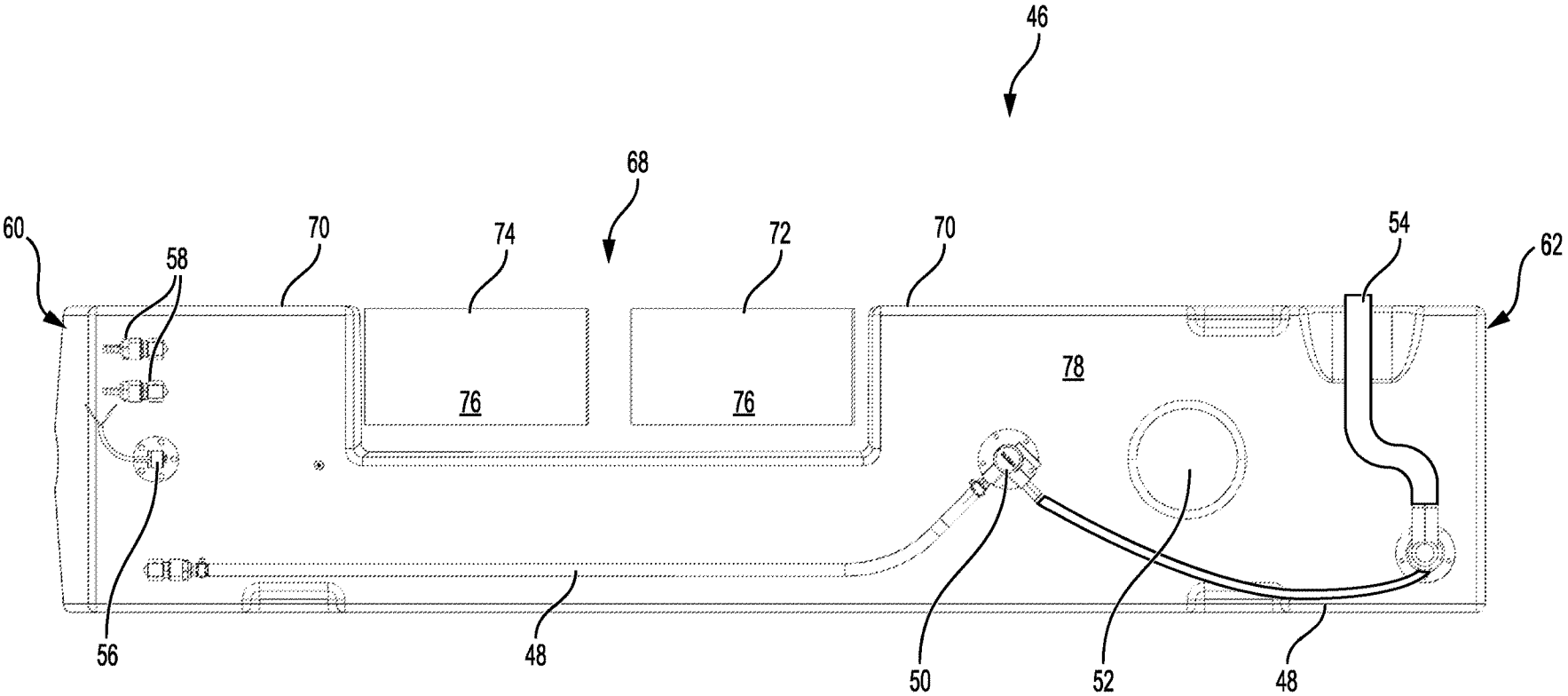
FIG. 6 is a top plan view of the fuel reservoir and the pair of batteries of FIG. 5.
Figure 7:
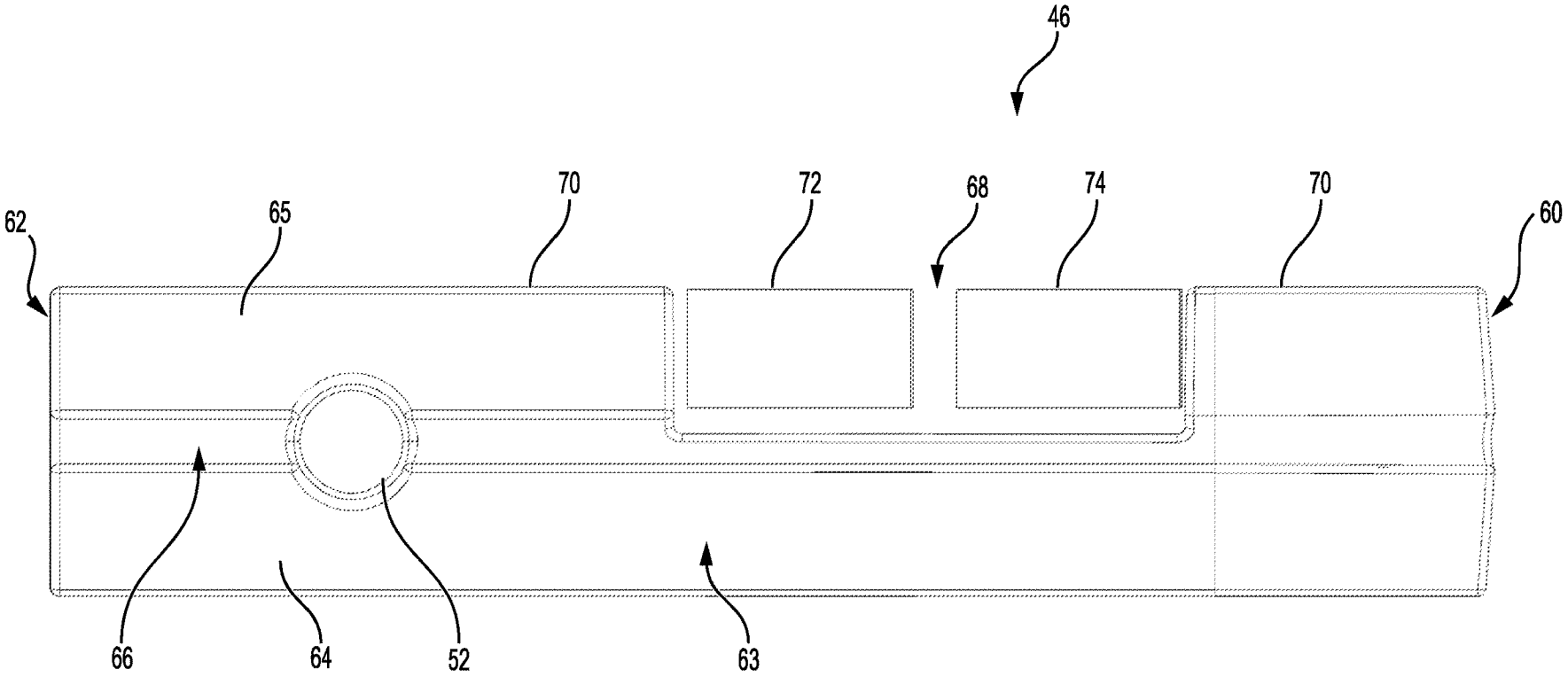
FIG. 7 is a bottom plan view of the fuel reservoir and the pair of batteries of FIG. 5.

The boat 10 further includes a fuel reservoir 46 fluidly connected to an internal combustion engine 23 of an outboard engine for propulsion of the boat 10. With reference to FIGS. 3, 5, and 6, the boat 10 further includes a vent hose 48, a vent fitting 50, a fuel fill hose 54, a fuel sender/level unit 56, as well as main and kicker engine fuel pick ups 58 connected to the fuel reservoir 46. The fuel reservoir 46 further defines a baffle 52. In the present embodiment, the baffle 52 is integrally molded with the fuel reservoir 46, but it is contemplated that the baffle could be a separate part connected inside the fuel reservoir. It is contemplated that there could be more than one baffle 52. It is also contemplated that the baffle 52 could be omitted.

The fuel reservoir 46 is disposed in the compartment 40 in order to centralize the large mass of the fuel reservoir 46 and to lower its position within the boat 10, keeping the center of gravity of the boat 10 as low and central as possible. The fuel reservoir 46 extends longitudinally over the keel 30. As seen in FIG. 4, the fuel reservoir 46 is disposed laterally centrally in the hull 14 of the boat 10. The fuel reservoir 46 is disposed longitudinally within the compartment 40, laterally centered about the keel 30. The fuel reservoir 46 is disposed in a rear portion of the boat 10. That is, the distance between a rear face 60 of the fuel reservoir 46 and a rear end 34 of the hull 14 is less than the distance between a front face 62 of the fuel reservoir 46 and a front end 32 of the hull 14.

Figure 8:
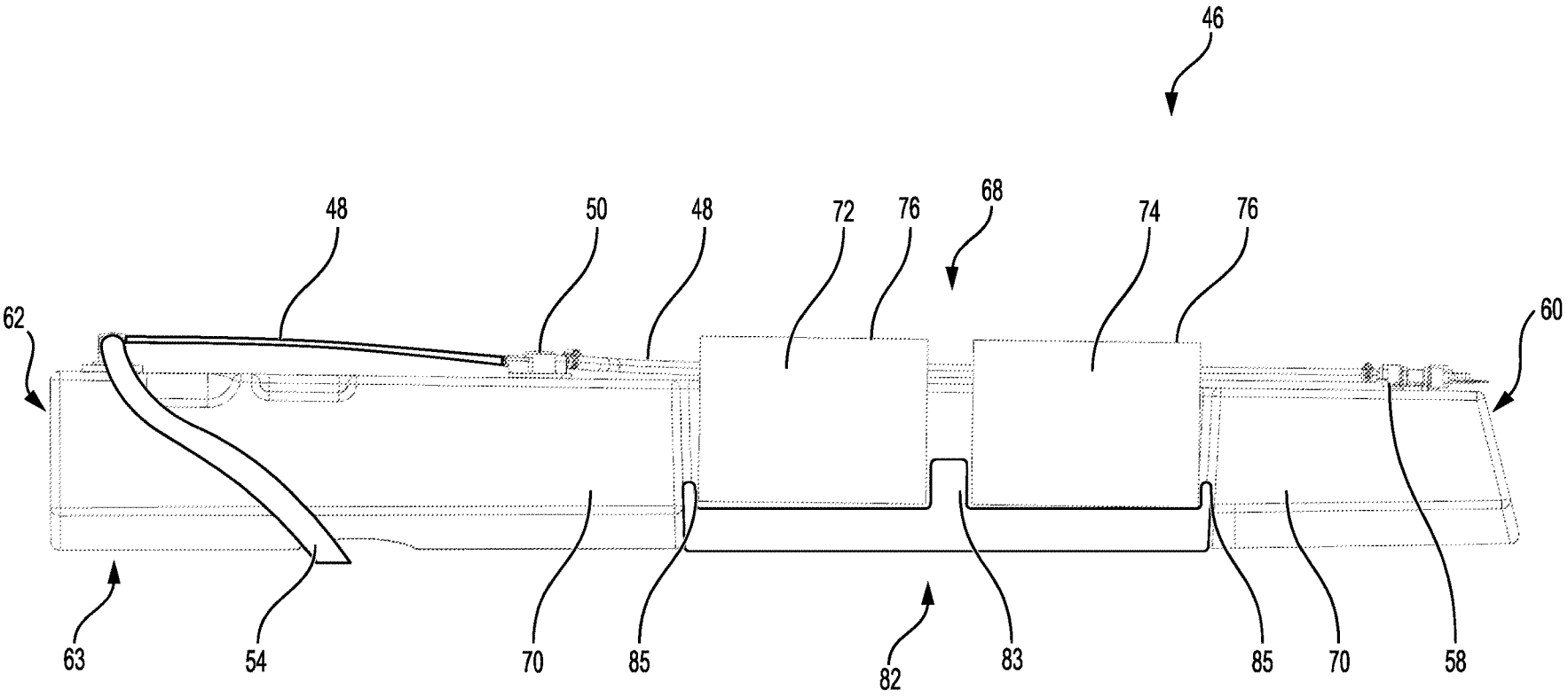
FIG. 8 is a left elevation view of the fuel reservoir and the pair of batteries of FIG. 5.
Figure 9:
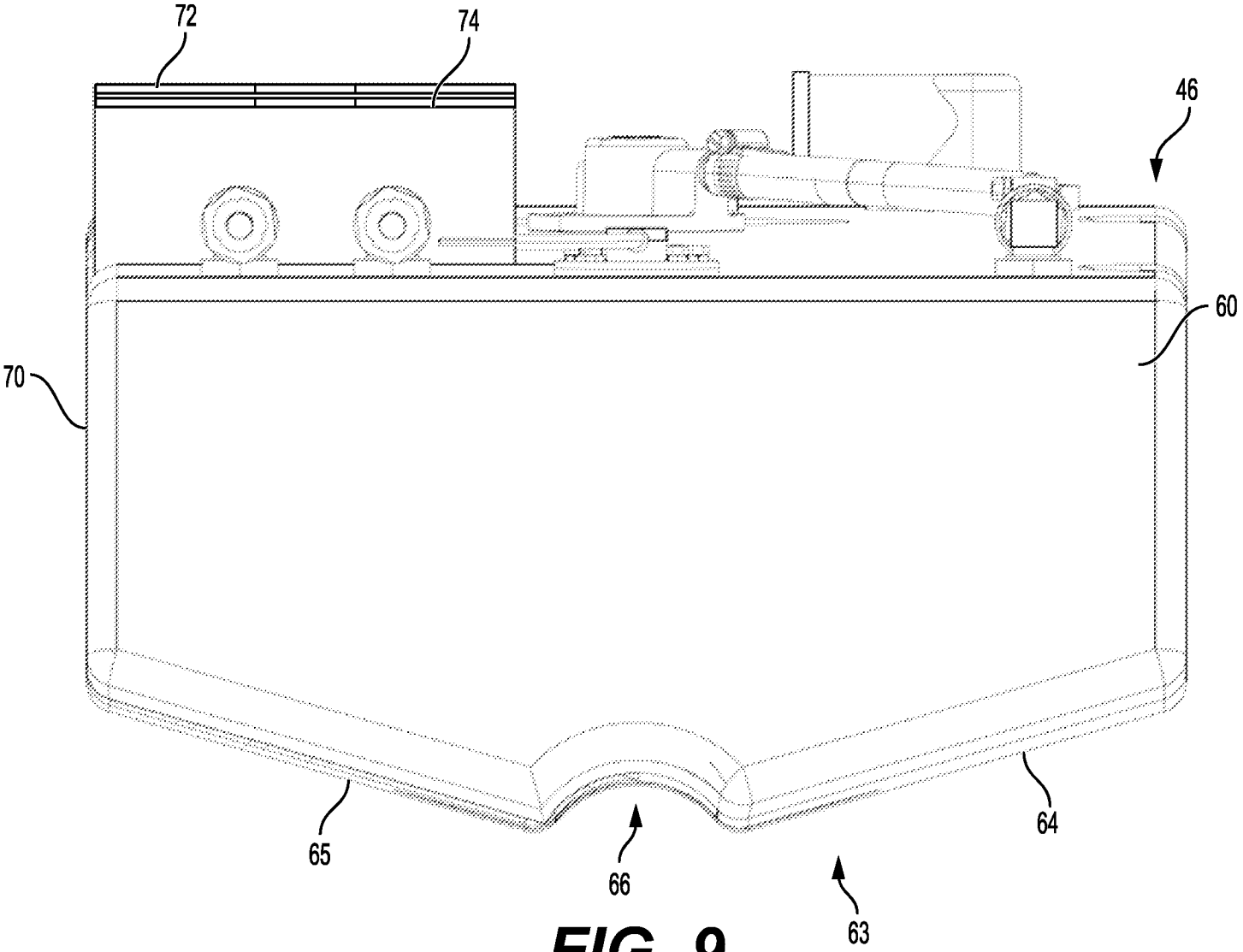
FIG. 9 is a rear elevation view of the fuel reservoir and the pair of batteries of FIG. 5.
Figure 10:
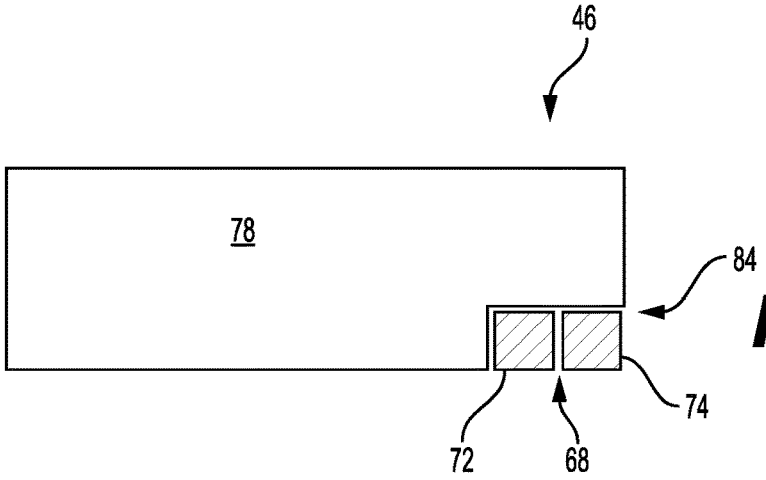
FIG. 10 is a top view of a fuel reservoir and a pair of batteries in accordance with an alternative embodiment of the present technology.

With reference to FIGS. 5 to 9, the fuel reservoir 46 will now be described in further detail. The fuel reservoir 46 is an elongated container extending longitudinally in the compartment 40. As seen in FIGS. 5 and 9, the fuel reservoir 46 has a bottom 63 including a bottom left surface 64 and a bottom right surface 65. The bottom left and right surfaces 64, 65 are angled relative to each other, thereby forming a V-shape. The angle between the bottom left and right surfaces 64, 65 of the fuel reservoir 46 is the same as the angle of the bottom 28 of the hull 14 such that the bottom left and right surfaces 64, 65 of the fuel reservoir 46 lay flat along the bottom 28 of the hull 14. The bottom 63 of the fuel reservoir 46 also defines a groove 66. With reference to FIG. 10, the groove 66 extends longitudinally along the entire length of the bottom 63 of the fuel reservoir 46. The width of the groove 66 is sized to prevent the bottom 63 from contacting the fasteners 36 which fasten the keel 30 to the hull 14 (see FIG. 4), thus allowing the bottom left and right surfaces 64, 65 of the fuel reservoir 46 to lay flat against the bottom 28 of the hull 14. It is contemplated, in alternative embodiments, that the fuel reservoir 46 may have a different configuration for the bottom 63. For example, the groove 66 may extend along only a portion of the bottom 63 of the fuel reservoir 46. In further alternative embodiments, the bottom 63 of the fuel reservoir 46 may be flat and the hull 14 may include a support structure configured to support the fuel reservoir 46 on the bottom 28 of the hull 14.

The fuel reservoir 46 includes an external hollowed portion 68. The external hollowed portion 68 is formed in an external surface of the fuel reservoir 46 and sized to receive a pair of batteries 72, 74 such that the batteries 72, 74 are partially surrounded by the external surface. As seen in FIGS. 5 to 8, the external hollowed portion 68 is a recess 68, extending laterally inward from a left lateral wall 70 of the fuel reservoir 46. It is contemplated that the recess 68 could alternatively extend laterally inward from a right lateral wall of the fuel reservoir 46. The recess 68 is positioned near a middle of the lateral wall 70. As such, when viewed from above, as in FIG. 6, the fuel reservoir is generally C-shaped.

The pair of batteries 72, 74 are electrically connected to the internal combustion engine 23 of the outboard engine, powering the starter motor and engine electronics, as well as other accessories of the boat 10. The pair of batteries 72, 74 are disposed within the compartment 40, in the recess 68 of the fuel reservoir 46. Storing the batteries 72, 74 in the compartment 40 and within the recess 68 of the fuel reservoir 46, positions the weight of the batteries 72, 74 in a lower and centralized position within the boat 10, thereby keeping the center of gravity low for a more balanced boat 10. Additionally, disposing the batteries 72, 74 in the compartment 40 frees space in the side and rear compartments 22, 24 above the deck 12 for items which are accessed more frequently than the batteries 72, 74 (such as fishing rods, tackle boxes, life jackets, etc.). The hatch 42 and the hatch door 44 are positioned above the batteries 72, 74 to provide access to the batteries 72, 74 for when the user needs to access them.

With reference to FIGS. 5 to 8, the battery 72 is positioned in front of the battery 74. It is contemplated that the batteries 72, 74 may, instead, be positioned in a side-by-side configuration. The batteries 72, 74 do not extend past the left lateral wall 70 of the fuel reservoir 46. As such, the batteries 72, 74 are positioned inwardly from the lateral side 70 of the fuel reservoir 46. A top 76 of the batteries 72, 74 extend beyond the top surface 78 of the fuel reservoir 46. As seen in FIG. 3, the batteries 72, 74 each have terminals 81 (one positive and one negative terminal, respectively) disposed on the top 76 of the batteries 72, 74 that are connected to a power cable 80. The power cable 80 extends along the top surface 78 of the fuel reservoir 46.

As shown in FIG. 8, the boat 10 further includes a support frame 82. The batteries 72, 74 are connected to the support frame 82, such that the support frame 82 supports the pair of batteries 72, 74 within the recess 68. The support frame 82 guides the positioning of the batteries 72, 74 within the recess 68. The support frame 82 include a spacing member 83 that, when the batteries 72, 74 are disposed within the support frame 82, is positioned in between the two batteries 72, 74. The support frame 82 includes additional spacing members 85 which are disposed in between the batteries 72, 74 and the fuel reservoir 46. The support frame 82 is connected to the hull 14. It is contemplated that, in alternative embodiments, the support frame 82 may be connected to another part of the boat 10, for example to the frame 24 or to the fuel reservoir 46.

It is contemplated that the external hollowed portion 68 may be sized and configured to accommodate any number of batteries. It is further contemplated, in alternative embodiments, that each battery may be disposed in a separate external hollowed portion 68 of the fuel reservoir 46.

Figure 11:
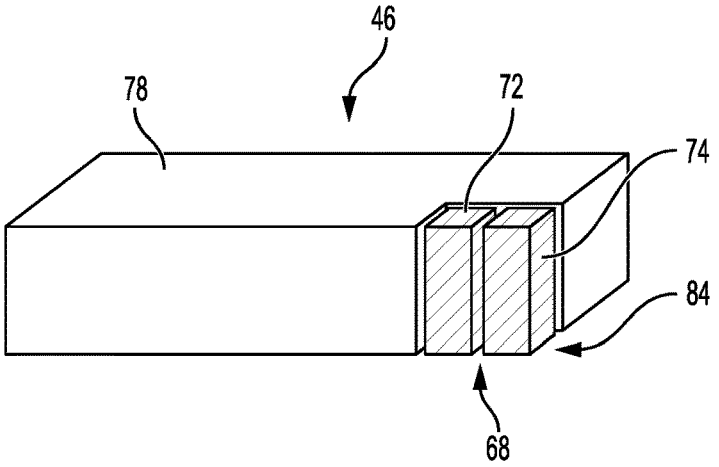
FIG. 11 is a perspective view of the fuel reservoir and the pair of batteries of FIG. 10.
Figure 12:
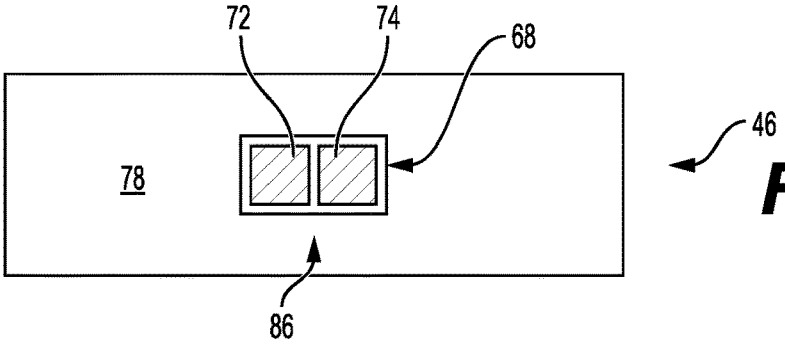
FIG. 12 is a top view of a fuel reservoir and a pair of batteries in accordance with another embodiment of the present technology.
Figure 13:
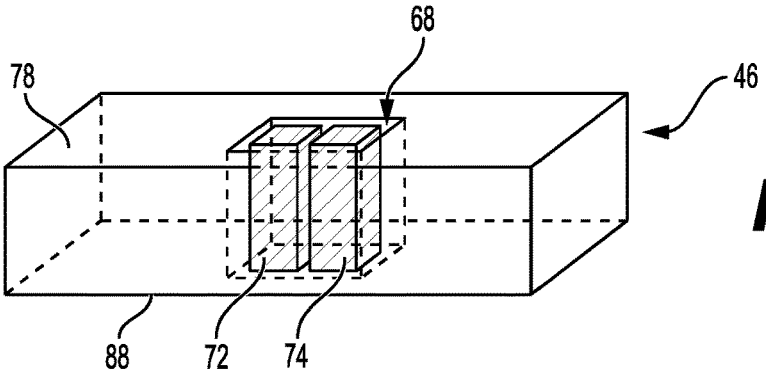
FIG. 13 is a perspective view of the fuel reservoir and the pair of batteries of FIG. 12.

In an alternative embodiment shown in FIGS. 10 and 11, the recess 68 (and the batteries 72, 74) is positioned at a corner 84 of the fuel reservoir 46. It is further contemplated that, alternatively, the recess 68 may be defined within a central portion 86 of the fuel reservoir 46 such that the recess 68 extends downwards from a top surface 78 of the fuel reservoir 46 but does not extend all the way through to the bottom of the fuel reservoir 46. In an alternative embodiment, shown in FIGS. 12 and 13, the external hollowed portion 68 is an aperture extending between the top surface 78 and the bottom surface 88 and disposed in the central portion 86 of the fuel reservoir 46. In further alternative embodiments, the fuel reservoir 46 may include any combination of external hollowed portion 68 configurations.

Figure 14:
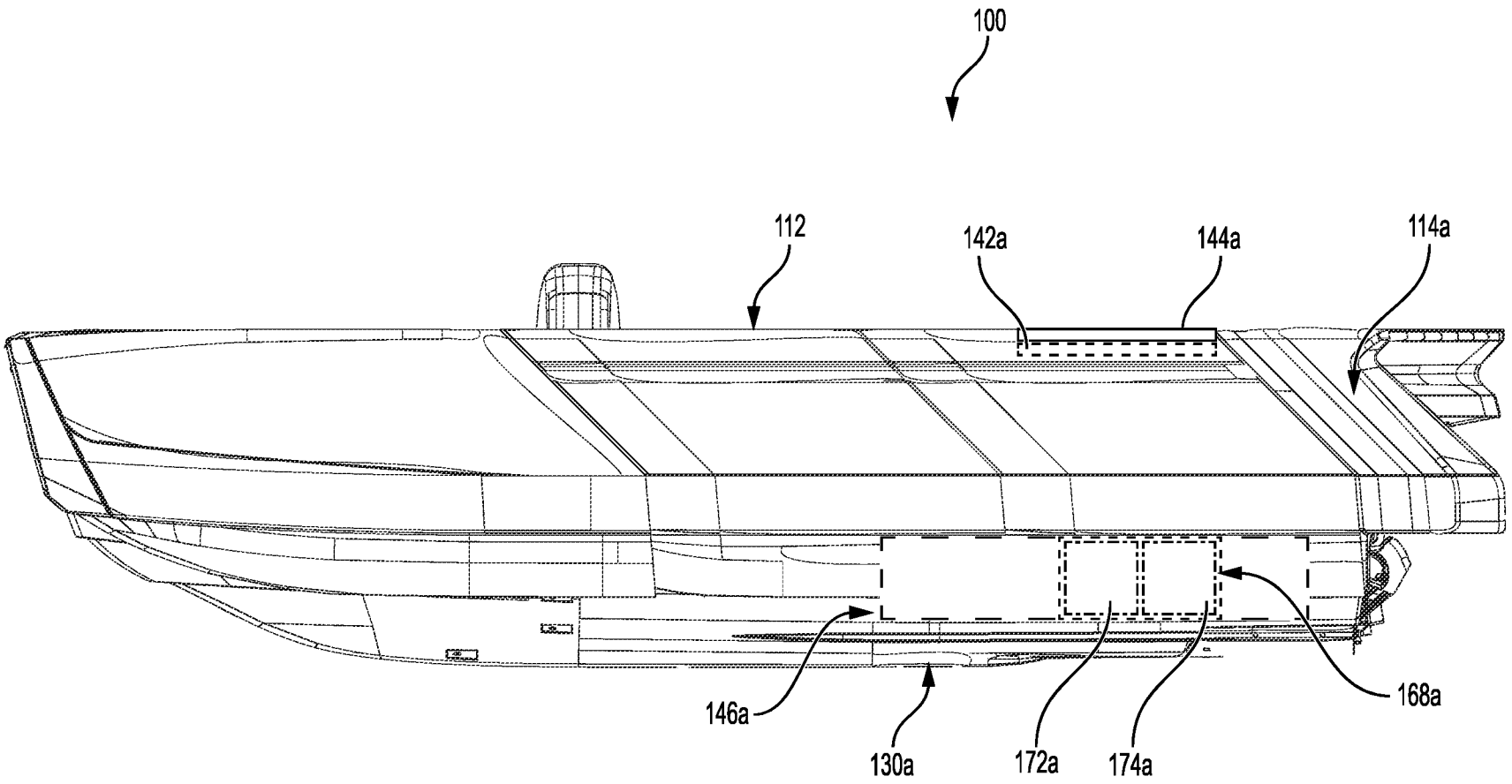
FIG. 14 is a left elevation view of a pontoon boat in accordance with another embodiment of the present technology.
Figure 15:
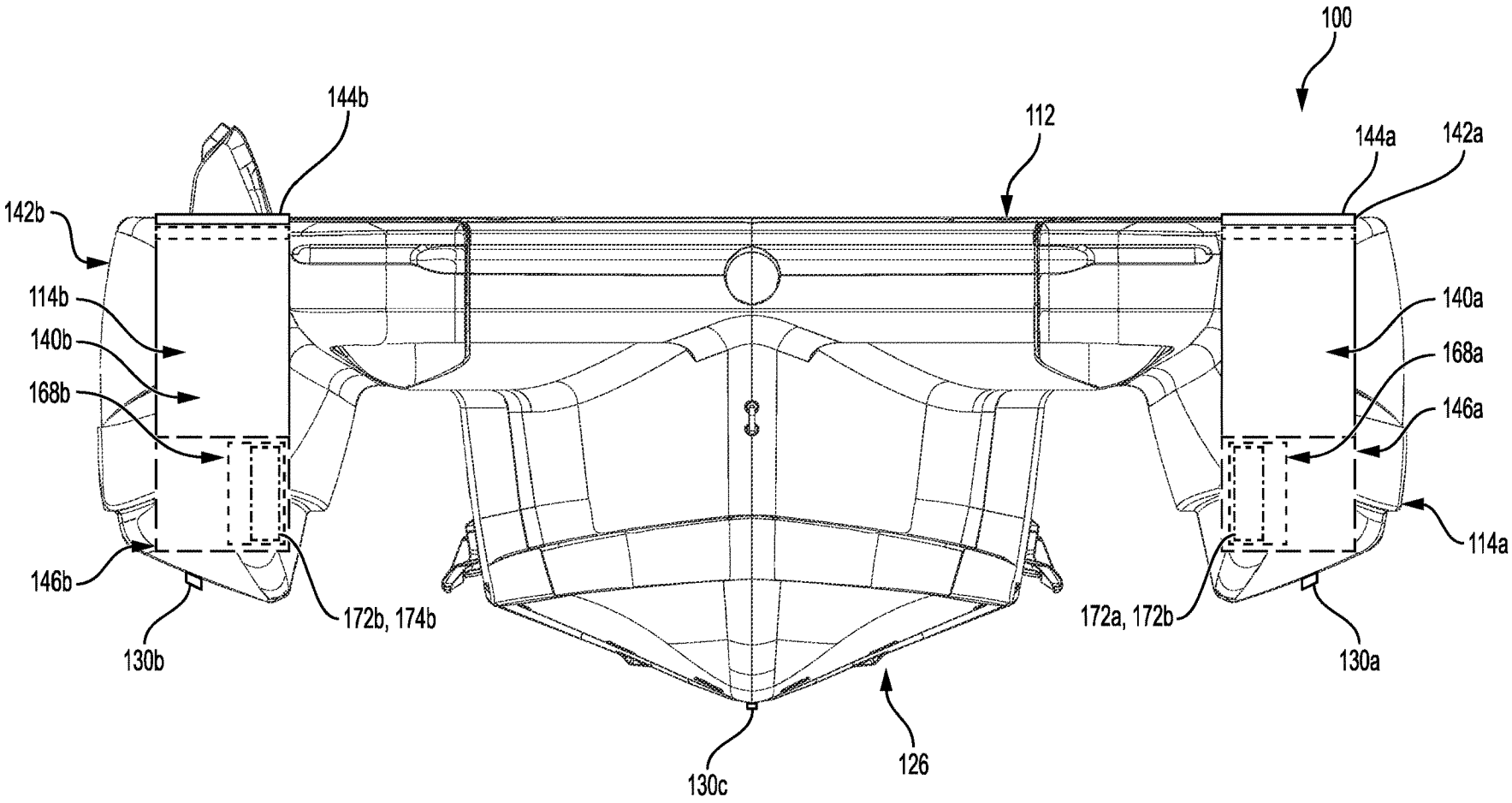
FIG. 15 is a front view of the pontoon boat of FIG. 14.

With reference to FIGS. 14 and 15, a boat 100, which is an alternative embodiment of the boat 10, is depicted. In this embodiment, the boat 100 is a pontoon boat 100 having a deck 112 with an upper surface 116. The boat 100 includes a hull 114 supporting the deck 112. The hull 114 has a central portion 126, a left pontoon **114*a*, and a right pontoon 114*b*. The left pontoon 114*a* and right pontoon 114*b* are laterally spaced apart from one another and separated by the central portion 126 that is laterally centered therebetween and to which both the left and right pontoons 114*a*, 114*b* are connected. Each of the left pontoon 114*a*, the right pontoon 114*b*, and the central portion 126 have a keel 130*a*, 130*b*, 130*c***.

The left pontoon **114*a* includes a compartment 140*a* defined between the left pontoon 114*a* and the deck 112. A portion of the deck 112 of the left pontoon 114*a* defines a hatch 142*a* for accessing the compartment 140*a* of the left pontoon 114*a*. The boat 100 includes a hatch door 144*a*, for selectively closing the hatch 142*a* of the left pontoon 114*a***.

The boat 100 includes a fuel reservoir 146*a*. The fuel reservoir 146*a* is similar to the fuel reservoir 46 previously described above, but is sized and shaped to fit within the compartment 140*a* of the pontoon 114*a*. A pair of batteries 172*a*, 174*a* (similar to the pair of batteries 72, 74 described above) are disposed in a hollow portion 168*a* of the fuel reservoir 146*a*. The external hollowed portion 168*a* of the fuel reservoir 146*a* is similar to the external hollowed portion 68 of the fuel reservoir 46 described above. The fuel reservoir 146*a* is disposed in the compartment 140*a* of the left pontoon 114*a*. The hatch 142 and hatch door 144*a* of the compartment 140*a* are disposed above the pair of batteries 172*a*, 174*a*.

The boat 100 includes a secondary fuel reservoir 146*b* and a secondary pair of batteries 172*b*, 174*b* disposed in an external hollowed portion 168*b* of the secondary fuel reservoir 146*b*. The fuel reservoir 146*b* is similar to the fuel reservoir 46 previously described above, but is sized and shaped to fit within the compartment 140*b* of the pontoon 114*b*. The external hollowed portion 168*b* of the fuel reservoir 146*b* is similar to the hollow portion 68 of the fuel reservoir 46 described above. The secondary fuel reservoir 146*b* is disposed in the compartment 142*b* of the right pontoon 114*b* and. A hatch 142*b* and a hatch door 144*b*, similar to the hatch 142*a* and the hatch door 144*a*, are disposed above the pair of batteries 172*b*, 174*b*.

The fuel reservoir 146*a* and the secondary fuel reservoir 146*b* are mirror images of one another. It is contemplated that the fuel reservoir 146*a* and the secondary fuel reservoir 146*b* may be identical to one another. It is also contemplated that one of the two fuel reservoirs 146*a*, 146*b* could be omitted.

It is contemplated that, in alternative embodiments, the boat 100 may include a fuel reservoir and a pair of batteries, similar to the fuel reservoir 46 and the pair of batteries 72, 74 described above, in a compartment defined by the central hull 126 and a portion of the deck 112 above the central hull 126. In such an embodiment, a corresponding hatch and hatch door would be provided in the portion of the deck 112 above the batteries. This fuel reservoir and batteries could be provided in addition to or instead of the fuel reservoirs 146*a*, 146*b* and batteries 172*a*, 172*b*, 174*a*, 174*b*.

It is contemplated that each of the left pontoon 114*a*, the right pontoon 114*b*, and the central hull 126 may each include a respective fuel reservoir and pair of batteries. It is further contemplated that the boat 100 may have a single fuel reservoir and pair of batteries disposed in any one of the left pontoon 114*a*, the right pontoon 114*b*, and the central hull 126.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:
a hull having a keel;
a deck supported by the hull;
a compartment defined between the hull and the deck;
a fuel reservoir disposed in the compartment and extending longitudinally over the keel, the fuel reservoir comprising an external hollowed portion; and,
at least one battery at least partially disposed in the hollowed portion;
wherein the external hollowed portion is a recess extending laterally inward from a lateral wall of the fuel reservoir;
wherein the recess is disposed longitudinally centrally along the lateral wall of the fuel reservoir.

2. The watercraft of claim 1 wherein the at least one battery is disposed in the recess and laterally inwardly from the lateral wall.

3. The watercraft of claim 1, wherein the fuel reservoir is laterally centered about the keel.

4. The watercraft of claim 1, wherein:
the fuel reservoir comprises a bottom left side surface and a bottom right side surface; and
the bottom left and right side surfaces define a generally V-shape.

5. The watercraft of claim 4, wherein:
the hull is a V-shaped hull; and
the generally V-shape of the fuel reservoir is angled substantially similar to the V-shaped hull such that the fuel reservoir lays flat on the hull.

6. The watercraft of claim 1, further comprising:
a plurality of fasteners fastening the keel to a bottom surface of a hull body of the hull; and
wherein a bottom surface of the fuel reservoir defines a longitudinally extending groove, the groove is sized for avoiding contact between the fasteners and the bottom surface of the fuel reservoir.

7. The watercraft of claim 1, further comprising a hatch door;
wherein:
the deck defines a hatch disposed above the at least one battery; and
the hatch door is configured to selectively close the hatch.

8. The watercraft of claim 1, wherein:
a longitudinal distance between a rear face of the fuel reservoir and a rear end of the hull is less than a longitudinal distance between a front face of the fuel reservoir and a front end of the hull.

9. The watercraft of claim 1, wherein the fuel reservoir is disposed laterally centrally in the hull.

10. The watercraft of claim 1, wherein:
the at least one battery comprises two batteries; and
the two batteries are disposed within the external hollowed portion of the fuel reservoir.

11. The watercraft of claim 10, wherein one of the two batteries is disposed in front of another one of the two batteries.

12. The watercraft of claim 1, further comprising a power cable, the power cable connected to a terminal of the at least one battery and extending along a top of the fuel reservoir.

13. The watercraft of claim 1, further comprising at least one of: an above-deck side compartment and an above-deck rear compartment.

14. The watercraft of claim 1, wherein:
the hull has a first pontoon, a second pontoon, and a central portion disposed laterally between the first and second pontoons;
the keel is a first keel of the first pontoon;
the second pontoon has a second keel;
the central portion has a third keel;
the compartment is a first compartment defined between the first pontoon and the deck;
the fuel reservoir is a first reservoir disposed in the first compartment; and
the at least one battery is at least one first battery disposed in the first compartment.

15. The watercraft of claim 14, wherein a second compartment is defined between the second pontoon and the deck; and the watercraft further comprises:

a second fuel reservoir disposed in the second compartment and extending longitudinally over the second keel, the second fuel reservoir comprising a second external hollowed portion; and at least one second battery at least partially disposed in the second external hollowed portion.

16. The watercraft of claim 15, wherein:

the at least one first battery comprises two first batteries; and the at least one second battery comprises two second batteries.

17. The watercraft of claim 16, further comprising a first hatch door and a second hatch door, wherein:

the deck defines a first hatch disposed above the two first batteries and a second hatch disposed above the two second batteries;

the first hatch door being configured to selectively closes the first hatch; and the second hatch door being configured to selectively closes the second hatch.

18. A watercraft comprising:

a hull having a keel;

a deck supported by the hull;

a compartment defined between the hull and the deck;

a fuel reservoir disposed in the compartment and extending longitudinally over the keel, the fuel reservoir comprising an external hollowed portion;

at least one battery at least partially disposed in the hollowed portion; and a support frame disposed in the external hollowed portion;

wherein the at least one battery is connected to the support frame.

* * * * *